United States Patent [19]

Frolov

[11] Patent Number: 4,904,005

[45] Date of Patent: Feb. 27, 1990

[54] ENTRANCE SECURITY SYSTEM

[75] Inventor: George Frolov, Farmington, Conn.

[73] Assignee: Harrow Products, Inc., Grand Rapids, Mich.

[21] Appl. No.: 272,992

[22] Filed: Nov. 18, 1988

[51] Int. Cl.[4] ..... E05C 17/56

[52] U.S. Cl. ..... 292/251.5; 292/144; 292/DIG. 65

[58] Field of Search ..... 292/DIG. 65, 251.5, 292/144, 201, 336.3

[56] References Cited

U.S. PATENT DOCUMENTS

| | | | |
|---|---|---|---|
| 2,197,802 | 4/1940 | James | 70/278 |
| 3,284,593 | 11/1966 | Hawkins | 200/61.64 |
| 3,751,086 | 8/1973 | Geringer | 292/144 |
| 3,751,088 | 8/1973 | Schlage et al. | 292/201 |
| 3,919,869 | 11/1975 | Fromm | 70/263 |
| 4,021,065 | 5/1977 | Geringer | 292/144 |
| 4,060,846 | 11/1977 | Conn | 361/193 |
| 4,439,808 | 3/1984 | Gillham | 361/144 |
| 4,470,625 | 9/1984 | Walsh et al. | 292/201 |
| 4,487,439 | 12/1984 | McFadden | 292/74 X |
| 4,501,203 | 2/1985 | Lyngstrup | 292/144 |
| 4,573,720 | 3/1986 | Nicolai | 292/144 |
| 4,625,848 | 12/1986 | Meyers et al. | 292/144 |
| 4,656,850 | 4/1987 | Tabata | 70/276 |
| 4,682,801 | 7/1987 | Cook et al. | 292/251.5 |

FOREIGN PATENT DOCUMENTS 1128186 3/1958 France .

*Primary Examiner*—Richard E. Moore
*Attorney, Agent, or Firm*—Chilton, Alix & Van Kirk

[57] ABSTRACT

A door security system where there is means defining a door entryway and a door pivotally attached to one side of said defining means, the door closing on the other side of the entryway and having a latch extending into a keeper in a jamb defining the entryway, the latch is movable between a latched and an unlatched position, a normally deenergized electromagnetic lock is provided for securing the door to the jamb defining the entryway when the electromagnetic lock is energized, the electromagnetic lock comprises an electromagnet mounted to one of the door and the entryway and an attractable armature on the other of the door and the entryway, a lockset is provided including a first handle on one side of the door for actuating the latch between latching and unlatching states, a first switch responsive to the position of the first handle being between a position to latch or unlatch the latch and to cause the first switch to move between open and closed states, a second handle on the other side of the door independent of the first handle for actuating the latch, a second switch in the doorway defining means being normally open the said latch is in latching position but closed when the latch is retracted, and a third normally closed switch operable by an authorized entry device, the switches being in series and arranged to complete an electrical circuit to the electromagnet when all of the switches are closed.

18 Claims, 4 Drawing Sheets

ENTRANCE SECURITY SYSTEM

FIELD OF THE INVENTION

This invention relates to door security systems and more particularly relates to such door security systems which utilize an electromagnetic locking device to secure a door against unauthorized entry, where the electromagnetic lock is only energized when unauthorized entry is attempted.

BACKGROUND OF THE INVENTION

Electromagnetic locks are well known and may comprise in one form a solenoid actuated bolt. However, at the present time, it is more common to have an electromagnet mounted to one of a doorway defining means and an attractable armature which is mounted to a door. This arrangement, in one form, may comprise an electromagnet which is recessed or mortised into the soffet of a door and an attractable armature which is carried mortised into or otherwise carried interiorly of the top edge of the door. Such an arrangement is exemplified in copending patent application Ser. No. 014,831 filed Feb. 13, 1987, now U.S. Pat. No. 4,840,411, issued June 20, 1989, and assigned to the assignee of this application. Such electromagnetic locks may also be mounted externally on the door frame on a corresponding vertical surface of the door, as exemplified in U.S. Pat. No. 4,439,808. These types of electromagnetic locks are exemplified in U.S. Pat. No. 4,487,439, and are referred to as electromagnetic shear locks. The holding force of the electromagnetic shear locks magnetically is not as great as the flush electromagnetic locks where the electromagnet engages the armature in a plane essentially parallel to the door to be guarded.

The shear type lock requires mechanical reinforcement, inasmuch as the holding force is not as great as the flush type electromagnetic lock. Flush mounted electromagnetic door lock in which the surfaces of the electromagnet and door mounted armature are parallel to the vertical plane of the door is exemplified in U.S. Pat. Nos. 4,682,801 and 4,573,720. In all of the present installations of electromagnetic locks, the electromagnet is constantly energized to secure the door. This consumes, over a period of time, a substantial amount of electrical energy.

Accordingly, the present invention provides an electromagnetic locking arrangement utilizing an electromagnet of either the shear type or the flush type which is normally deenergized, saving on consumption of electrical power, but will be energized immediately upon a person attempting to gain unauthorized entry into a secured area, while permitting egress of authorized persons within the secured area.

SUMMARY OF THE INVENTION

Briefly stated, the invention in one form thereof, as applied to a doorway in which unauthorized entry is guarded against from one direction, but egress is permitted from within the secured area, comprises an electromagnic of either the shear type or flush type, which is normally deenergized and requires an authorized entry device into the secured area, such as a card to be inserted into a card reader or a key operated switch to gain authorized access into the secured area. However, a person wishing to leave the secured area may easily do so by turning a handle which will prevent energization of the normally deenergized electromagnetic lock.

However, if unauthorized entry is attempted, the electromagnetic lock will immediately be energized and block such unauthorized entrance. If the person wishing to enter the secured area has an authorized entry device, such as a key or a card reader, this will open a switch which will prevent energization of the electromagnet when the exterior handle is actuated to unlatch a door bolt.

In a specific form, the invention comprises an electromagnetic lock of one of the types described in which three switches are in series with the electromagnet, or a switching device such as a relay, which controls the application of power to the electromagnet. These three switches are first, a switch actuated by turning of the handle on the secured side of the door to permit egress. Such switch is opened upon turning of the handle from the secured side. An additional switch senses the position of the latch bolt actuated by the handle and will close if the latch bolt is retracted. The third switch is normally closed but may be opened by an authorized entry device, such as a card reader or a key, from the exterior of the secured area. The switch controlled by the door handle on the secured side of the door is normally closed, but may be opened by a person seeking egress when such person turns the handle. The switch responsive to the position of the latch bolt, which is operated from the exterior side of the secured area, will close if one attempts unauthorized entry. Thus, if one attempts unauthorized entry and turns the handle from the exterior of the secured area, all three switches will be closed and the electromagnet will be energized to prevent unauthorized entry. However, if one has an authorized entry device, and opens the third switch with the authorized entry device, the third switch will open and authorized entry will be permitted.

An object of this invention is to provide a new and improved door security system which prevents unauthorized entry into a secured area, but which does require continuous energization of an electromagnet.

Another object of this invention is to provide a door security system of the type described, which permits easy egress from the secured area.

A further and important object of this invention is to provide a door system of the type described where the electromagnetic lock is not constantly energized, but is energized only upon a person seeking unauthorized entry.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF A PREFERRED EMBODIMENT OF THE INVENTION

Figure 1:
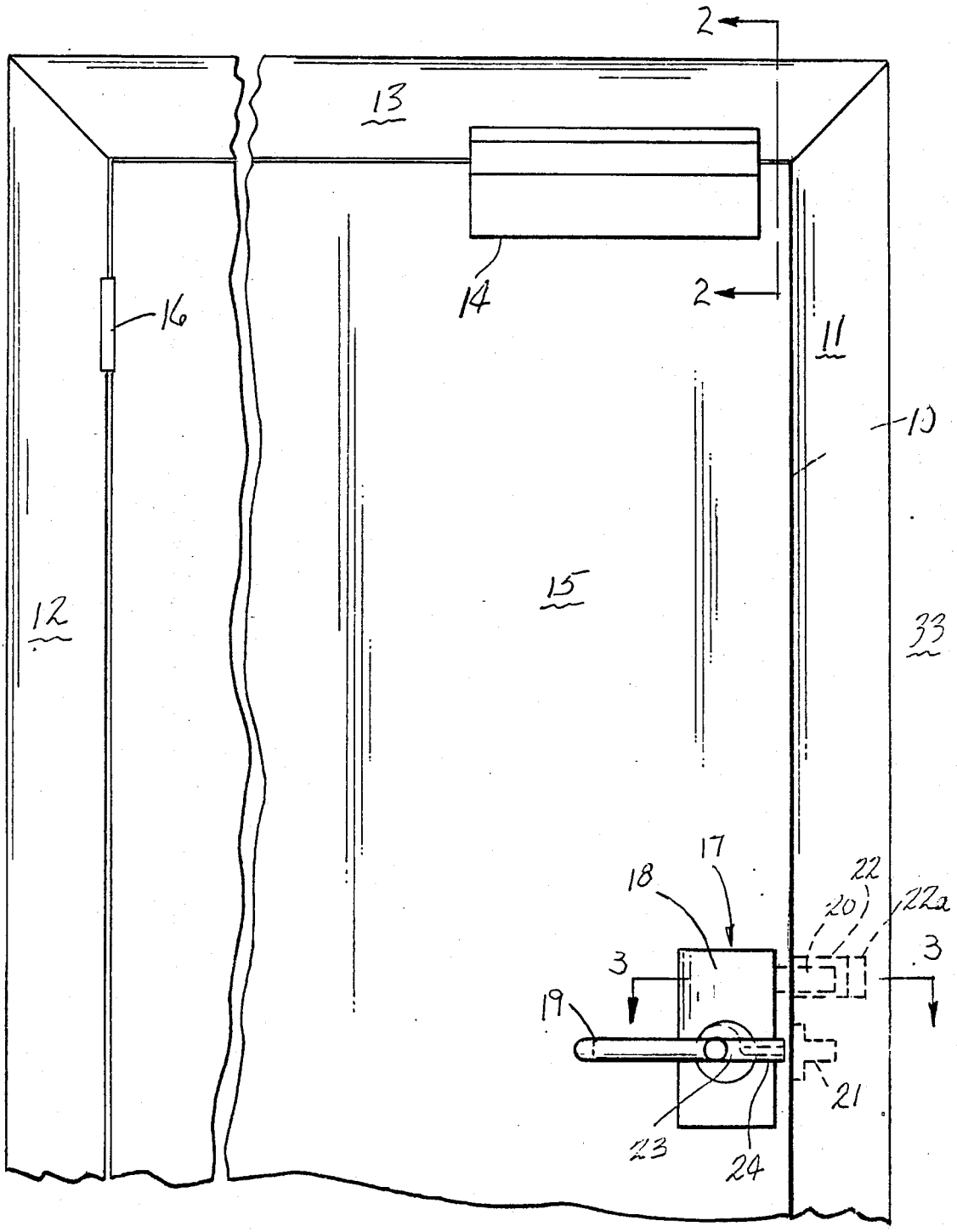
FIG. 1 is an elevation of a doorway with an outwardly opening door therein which is secured with an electromagnetic lock.
Figures 2, 3:
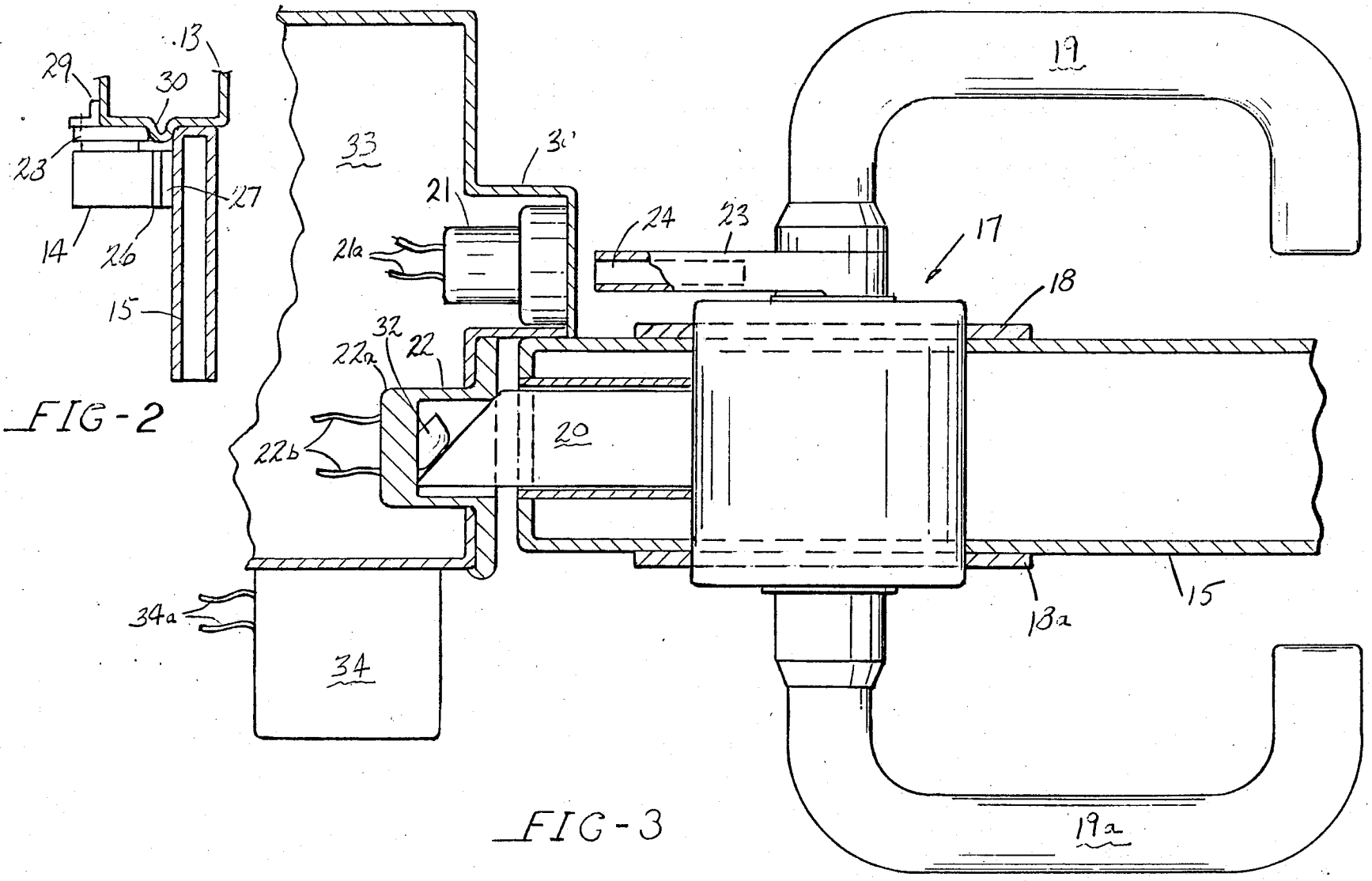
FIG. 2 is a view seen in the plane of lines 2—2 of FIG. 1.
FIG. 3 is a view seen in the plane of lines 3—3 of FIG. 1.

Referring now to the drawings, and in particular, FIGS. 1, 2 and 3, a doorway 10 is defined by upright frames 11 and 12 and an upper soffet member 13. An electromagnet 14 is mounted to soffet member 13, as hereinafter described, and is adapted to attract an armature mounted to the door. The door, as shown in FIG. 1, is hinged on the left side by hinges 16 (only one shown).

Door 15 has mounted thereto a lockset 17 which includes a mounting plate 18 on either side of the door, an actuating handle 19 and a latch bolt 20 which extends into a keeper 21 defined in frame 11. The latch bolt 20, when in an extended position, engages an actuating arm of a switch 22, hereinafter more fully described, and holds this switch in an open condition. The lockset includes an extension 23 having a permanent magnet 24 therein which is adjacent a magnetic reed switch 25 recessed into frame 11. Extension 23 with magnet 24 therein, may be added on the shaft of handle 19 to be turned therewith, and remove influences from reed switch 21.

Referring specifically to FIG. 2, the electromagnet locking assembly includes an armature plate 26 secured to door 15 on a spacer 27 to permit contact with electromagnet 14 which is mounted to soffet 13 by means of a mounting plate 28 secured to the soffet and to a mounting bracket 29.

The soffet 13, as shown, is formed of metal and includes a door stop 30 defined thereon. The frame members 11 and 12 have a similar door stop 30 as hereinafter described. The illustrated arrangement is for an outwardly opening door where the secured area is to the inside.

The lockset 17 is conventional and includes two handles, the inside handle 19 and an outside handle 19*a* (FIG. 3), both of which are effective to independently retract latching bolt 20 which extends into a keeper 22 which includes a monitor strike 22*a*. Monitor strike 22*a* includes a normally open switch when an arm 32 thereof is engaged by bolt 20. Leads 22*b* are shown extending from the switch. Such combination keepers and sensing switches are known as monitor strikes and are readily available from many manufactures. For example, the Von Duprin Division of Ingersoll-Rand Corporation markets a Model No. 4582, monitor strike which has a normally open switch, but which switch will close if bolt 20 is retracted from arm 32. As shown in FIG. 3, the secured area is designated by the reference S.

The reed switch 21 is normally closed when the magnet 24 is in juxataposition thereto as shown in FIG. 3 and FIG. 1. However, if handle 19 should be turned to open door 15, the reed switch 21 will open, due to the removal of the magnet 24 in influence thereon.

As previously mentioned, the handles 19 and 19*a* independently actuate bolt 20 without effecting each other. The turning of handle 19*a* will not produce turning of handle 19. A lockset of this type is available from many sources, for example, the Corbin Division of Emhart Corporation of Farmington, Conn., Model Nos. 9510 or 9520.

Also mounted to a wall 33 defining the door opening 10 is an authorized entry unit, such as a card reader 34. Card reader 34 is of the type with a normally closed switch which will open upon insertion of an authorized card. Electrical leads 34*a* are taken from a card reader switch 34*b*. Alternatively, the authorized entry device could be a key actuated switch.

Figure 4:
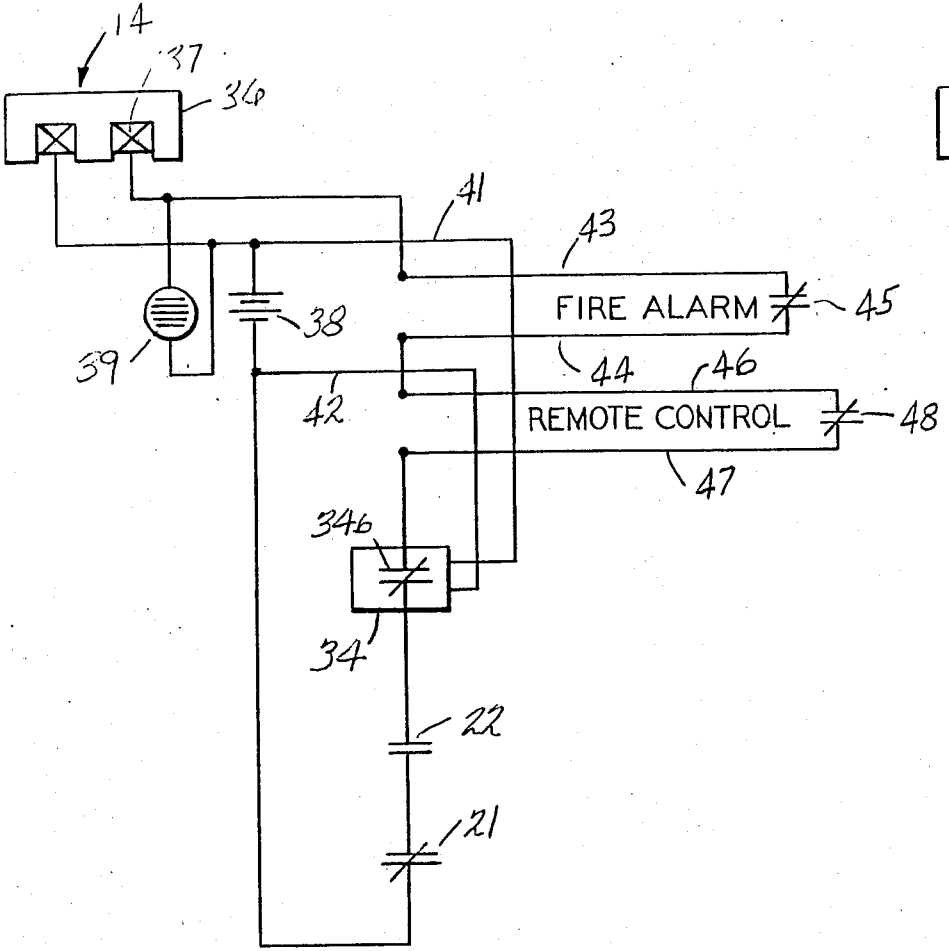
FIG. 4 is a schematic diagram of a control circuit utilized in conjunction with the system of FIGS. 1–3.

Reference is now made to FIG. 4 which is a schematic diagram representative of a control circuit for the electromagnet 14. The electromagnet 14 is shown as comprising an E-shaped core 36 with a coil 37 about the central leg. The magnet may be energized from a source such as battery 38. Connected across the battery 38 in parallel with the coil of the electromagnet may be a horn 39 which would emit a warning sound if the electromagnet is energized. This would be indicative of an attempt of unauthorized entry.

In series with the battery 38 is a card reader switch 34*b*, the latchbolt operated switch 22, and reed switch 21, shown in their normal conditions.

If a person with an authorized entry device should open switch 34*b*, he could then turn handle 19*a* and open door 15 to gain access to the secured area behind door 15. If a person should attempt to gain unauthorized access by actuating handle 19*a*, bolt 20 would retract and switch 22 would close. This would complete a circuit through battery 38 and coil 37 of the electromagnetic energizing the coil and latching armature 26 to electromagnet 14 and result in locking of the door. At this time all of switches 24*b*, 22 and 21 are closed. If someone within the secured area should want to gain egress from the secured area and turned handle 19, magnet 24 would move away from a position where it would influence reed switch 21, and reed switch 21 would open, thus preventing energization of electromagnet 14, even though switch 22 would close as latch bolt was retracted from keeper 22.

The battery 38 supplies electrical energy over lines 41 and 42 to the card reader 34 to enable switch 34*b* to open when an authorized entry card is inserted in the card reader 34. If card reader 34 is deleted in favor of a key operated switch, the lines 41 and 42 would not be necessary. The circuit of FIG. 4 may also be modified by the provision of lines 43 and 44 to a normally closed fire alarm switch 45 and lines 46 and 47 to a central remote control unit which may open a switch 48 to prevent energization of electromagnet 14.

Figure 5:
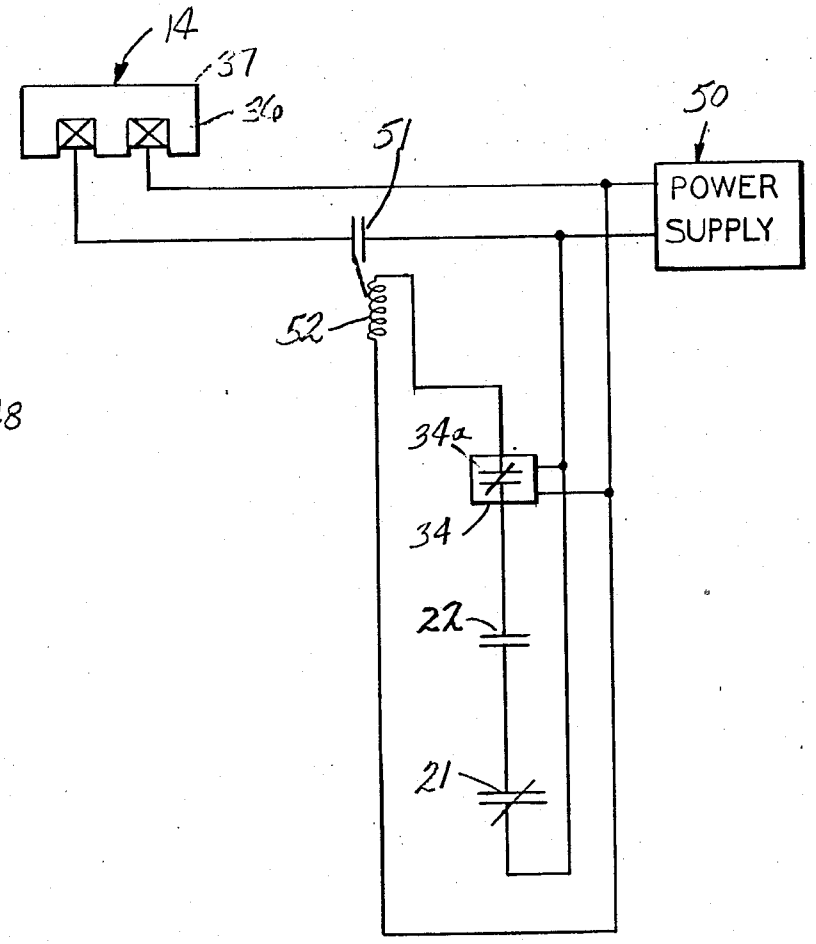
FIG. 5 is a schematic diagram of an alternate control circuit which may be utilized in conjunction with the system of FIGS. 1-3.

FIG. 5 is a schematic diagram which is a modification of FIG. 4 and permits a plurality of electromagnetic locks to be energized from a single power supply 50. Here a power supply 50 is adopted to be connected to a plurality of electromagnets through contacts 51 (only one shown) controlled by a relay 52 which is in circuit with switches 34*b*, 22 and 21, as previously described. The power supply 50 may also supply electrical energy to card reader 34. Alternatively, the card reader may be replaced with a key operated switch. In either case, the electromagnet is not energized unless there is an attempt at unauthorized entry by turning of handle 19*a*. This provides a substantial savings in electric power.

It may be seen that with the arrangement described, the electromagnet is not energized unless unauthorized entry is attempted. This saves considerable energy. The source of electrical energy could be a low voltage power supply as exemplified in FIG. 5, or a battery as exemplified in FIG. 4. In either case, electrical power is applied to the electromagnetic lock only when unauthorized entry is attempted.

Figure 6:
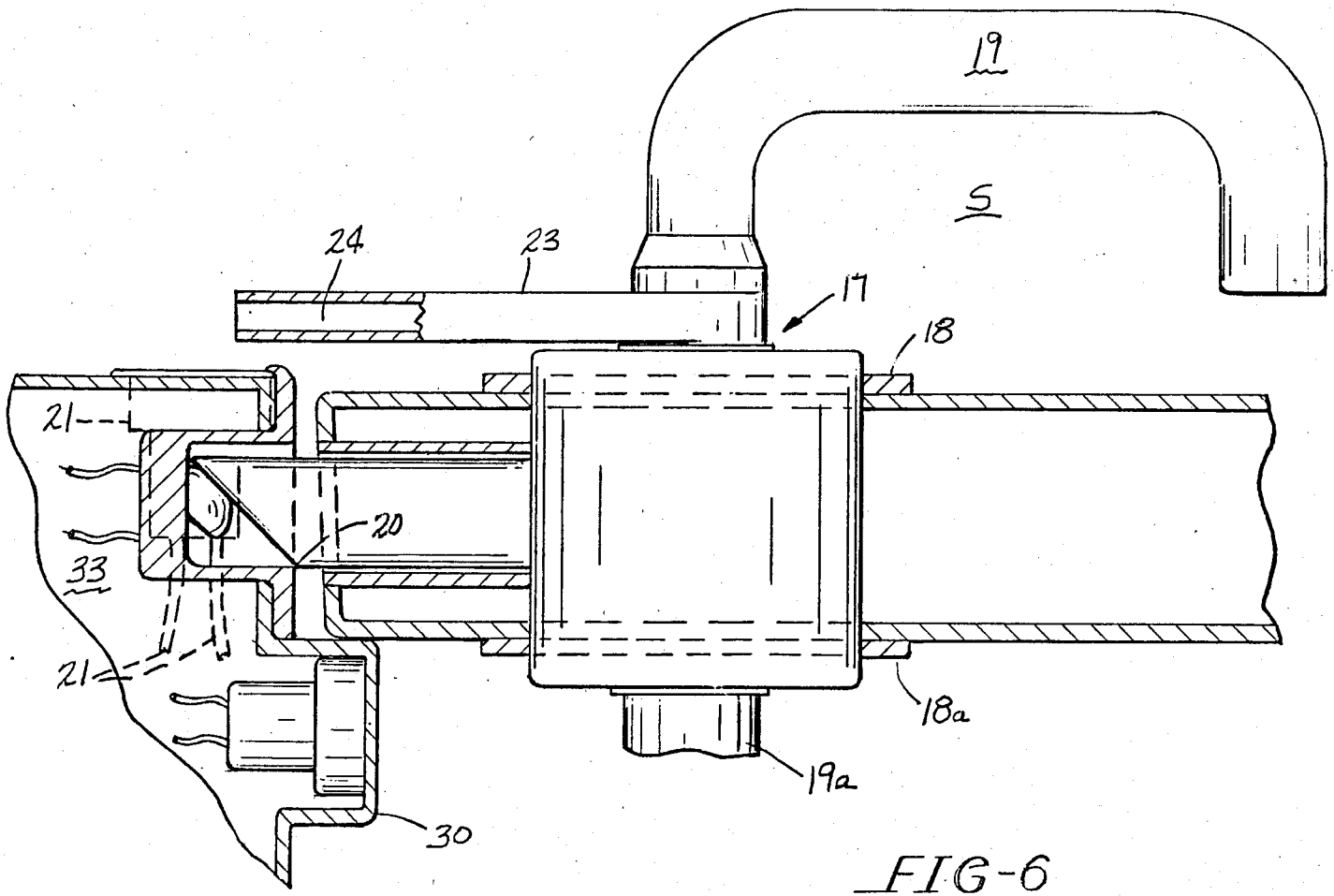
FIG. 6 is a view similar to FIG. 3, but showing a doorway with an inwardly opening door.

The invention has been described as applied to an outwardly opening door 15. However, it will be apparent that it could be applied to a door opening inwardly to a secured area. This would require the positioning of door 15 on the other side of stop 30 together with repositioning of other elements as shown in FIG. 6. In FIG. 6, the same reference numerals are utilized for the same elements as in the previously discussed constructions. However, FIG. 6 is simplified with respect to FIG. 3 and is set forth merely to show an interior opening door into an area which would have other emergency doors for egress.

In FIG. 6, the keeper for latch bolt 20 is eliminated for simplicity of illustration. The reed switch 21 is mounted in frame 33 so as to face the secured area. Adaptor 23 is extended so as to present magnet 24 to reed switch 21 in a position that normally closes switch 21, as previously described.

In the arrangement of FIG. 6, a flush type electromagnetic lock would be mounted to the exterior of door 15 on the side of handle 19*a*, or alternatively, an electromagnetic shear lock would be mortised into soffet 30, and an attractable armature mortised into door 15.

The secured area is also designated by the reference 5 in FIG. 6.

Having thus described the invention, what is claimed is:

1. A door security system where there is means defining a door entryway and a door pivotally attached to one said of said defining means, said door closing on the other side of said entryway and having a latch bolt extending into a keeper in said defining means, said latch bolt being movable between a latched and an unlatched position with respect to said keeper, an electromagnetic lock for securing said door in said entryway when said electromagnetic lock is energized, said electromagnetic lock comprising an electromagnet mounted to one of said door and said entryway and an attractable armature on the other of said door and entryway, a first handle on one side of said door positionable between first and second positions for actuating said latch bolt between latching and unlatching states, a first switch responsive to the position of said first handle being between first and second positions to latch or unlatch said latch bolt and to cause said first switch to move between open and closed states, a second handle on the other side of said door independent of said first handle for actuating said latch bolt, a second switch in said door entryway defining means being normally open when said latch bolt is in latching position but closed when said latch bolt is retracted, a third normally closed switch operable by an authorized entry device, said switches being in series and arranged to complete an electrical circuit to said electromagnet when all switches are closed.

2. The system of claim 1 where said third switch is opened by an authorized entry device, said second switch is closed when said first handle is operated to unlatch said latch bolt and said first switch is opened when said first handle is operated to unlatch said latch.

3. The system of claim 2 where said electromagnet is normally deenergized, but becomes energized when all three of said switches are closed.

4. The system of claim 1 where said first switch is a magnetic reed switch and said first handle carries a magnet thereon positioned to close said reed switch when said latch bolt is in a latching position.

5. The system of claim 1 further comprising a battery and wherein said electromagnetic lock is energizable by said battery.

6. The system of claim 1 further including at least one other normally closed switch in series with said first, second and third switches.

7. The system of claim 1 where said door opens outwardly from a secured area.

8. The system of claim 1 where said door opens inwardly into a secured area.

9. The system of claim 1 where said second switch is in said keeper.

10. A door security system where there is means defining a door entryway and a door pivotally attached to one side of said defining means, said door closing on the other side of said entryway and having a latch bolt extending into a keeper in said doorway defining means in said entryway, said latch bolt being movable between a latched and an unlatched position with respect to said keeper, a normally deenergized electromagnetic lock for securing said door in said entryway when said electromagnetic lock is energized, said electromagnetic lock comprising an electromagnet mounted to one of said door and said entryway and an attractable armature on the other of said door and entryway, a first handle on one side of said door for actuating said latch bolt between latching and unlatching states, a first normally closed switch responsive to the position of said first handle to latch said latch bolt and to cause said first switch to open when said first handle is actuated to unlatch said latch bolt, a second handle on the other side of said door independent of said first handle for actuating said latch bolt, a second switch in said doorway defining means being normally open when said latch bolt is in latching position but closed when said latch bolt is retracted, a third normally closed switch operable by an authorized entry device, said switches being in series and arranged to complete an electrical circuit to said electromagnet when all switches are closed.

11. The system of claim 1 where said third switch is opened by an authorized entry device, said second switch is closed when said first handle is operated to unlatch said latch bolt and said first switch is opened when said first handle is operated to unlatch said latch.

12. The system of claim 2 where said electromagnet is normally deenergized, but becomes energized when all three of said switches are closed.

13. The system of claim 10 where said first switch is a magnetic reed switch and said first handle carries a magnet thereon positioned to close said reed switch when said latch bolt is in a latching position.

14. The system of claim 10 where said electromagnet lock is energizable by a battery.

15. The system of claim 10 further including at least one other normally closed switch in series with said first, second and third switches.

16. The system of claim 10 where said door opens outwardly from a secured area.

17. The system of claim 10 where said door opens inwardly into a secured area.

18. The system of claim 10 where said second switch is in said keeper.

* * * * *